US006834465B2

(12) United States Patent
Hoberman

(10) Patent No.: US 6,834,465 B2
(45) Date of Patent: Dec. 28, 2004

(54) FOLDING COVERING PANELS FOR EXPANDING STRUCTURES

(76) Inventor: Charles Hoberman, 472 Greenwich St., New York, NY (US) 10013

( * ) Notice: Subject to any disclaimer, the term of this patent is extended or adjusted under 35 U.S.C. 154(b) by 0 days.

(21) Appl. No.: 10/303,550

(22) Filed: Nov. 25, 2002

(65) Prior Publication Data

US 2003/0097801 A1 May 29, 2003

Related U.S. Application Data

(60) Provisional application No. 60/333,418, filed on Nov. 26, 2001.

(51) Int. Cl.[7] ..... E04B 1/34
(52) U.S. Cl. ..... 52/3
(58) Field of Search ..... 52/70, 71, 646, 52/DIG. 10, 81.1, 81.2, 3

(56) References Cited

U.S. PATENT DOCUMENTS 3,059,658 A * 10/1962 Finlayson ..... 135/147
3,660,952 A * 5/1972 Wilson ..... 52/81.4
3,710,806 A * 1/1973 Kelly et al. ..... 135/145
3,888,056 A * 6/1975 Kelly et al. ..... 52/109
4,068,422 A * 1/1978 Sumner ..... 52/81.2
4,113,206 A * 9/1978 Wheeler ..... 244/31
4,290,244 A * 9/1981 Zeigler ..... 52/81.3
4,413,452 A * 11/1983 Wilkinson ..... 52/82
4,876,831 A * 10/1989 Runyon ..... 52/70
5,274,980 A * 1/1994 Zeigler ..... 52/646
5,907,931 A * 6/1999 Sun ..... 52/81.4
6,082,056 A * 7/2000 Hoberman ..... 52/81.5

* cited by examiner

*Primary Examiner*—Leslie A. Braun
(74) *Attorney, Agent, or Firm*—Jeffrey M. Kaden; Gottlieb, Rackman & Reisman, P.C.

(57) ABSTRACT

Reversibly expanding covering elements for truss structures made up of scissor-assemblies that are connected together by hub elements structures. These covering elements are comprised of a folded sheet of flexible material such as cardboard or a plastic sheet, or alternatively, comprised of planar panels that are hinged together. As the truss structure expands and contracts, the covering element is compressed and expanded along with it.

20 Claims, 7 Drawing Sheets

FOLDING COVERING PANELS FOR EXPANDING STRUCTURES

RELATED APPLICATIONS

This application claims the filing date of provisional patent application No. 60/333,418, filed Nov. 26, 2001.

BACKGROUND OF THE INVENTION

Structures that transform in size or shape have numerous applications in many fields. My prior patent, U.S. Pat. No. 5,024,031, hereby incorporated by reference as if fully disclosed herein, teaches methods for constructing expandable truss-structures in a variety of shapes. The teachings therein have been used to build structures for diverse applications including architectural uses, public exhibits and unique folding toys.

Such a truss structure is made up of scissor-assemblies (or "tong-assemblies") that are connected together by hub elements. These scissor-assemblies form an open lattice-like structure that may be reversibly expanded and contracted. The structures previously disclosed are essentially expandable frameworks, no covering surfaces within the framework were provided. Such a framework can be improved upon.

It is, therefore, an object of this invention to provide covering surfaces within the framework of these scissor-assemblies.

It is a further object to provide covering surfaces for these scissor-assemblies that have a degree of structural integrity and have controlled movement when the scissor-assemblies expand and contract.

It is a further object of this invention to provide novel structures that, in their contracted state, have empty spaces within which the covering elements are housed. The covering elements, therefore, do not protrude outside of the contracted structure's profile.

It is a related object to provide novel structures that, in their extended state, the covering elements span the polygonal openings that are bordered by scissor assemblies, and are thus capable of providing an essentially complete and continuous surface.

The above and related objects are addressed by the instant invention.

SUMMARY OF THE INVENTION

I have invented a novel method of providing reversibly expanding covering elements for truss structures made up of scissor-assemblies that are connected together by hub elements structures. These covering elements are comprised of planar panels that are hinged together, or alternatively, comprised of a folded sheet of flexible material such as paper or a plastic sheet.

The benefits of such a technique are multiple. By providing a "skin" to the expandable truss structures, numerous new applications are possible. Such applications may include portable shelters, transformable lighting products, toys and games that expand with printed images, and foldable projection screens.

The disclosed invention thus represents a significant advance over the earlier invention, and can lead to numerous practical embodiments.

DETAILED DESCRIPTION

Figure 1:
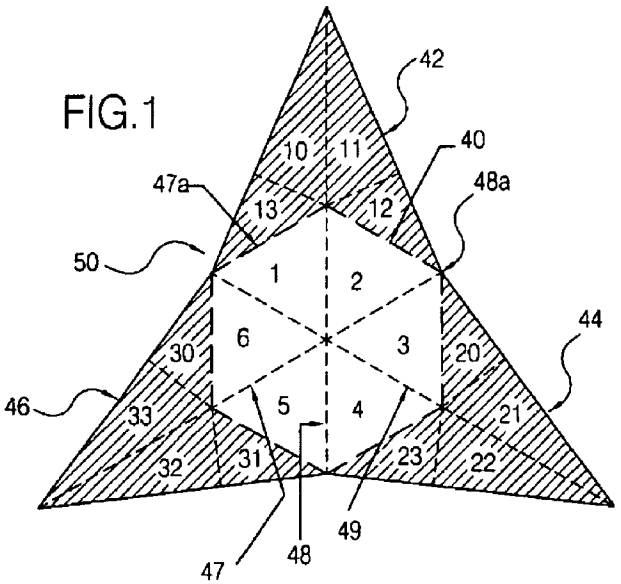
FIGS. 1–4 show a covering element according to the invention.

FIG. 1 shows a plan view of a covering element 50 consisting of a central hexagonal polygonal area 40, and three extensions 42, 44 and 46. In the preferred embodiment, the covering element 50 and the three extensions 42, 44 and 46 are constructed out of a single piece of material such as strong paper or cardboard that can withstand repeated folding and unfolding. Alternatively, plastics or other similar foldable materials may be used. Hexagonal Central area 40 is comprised of six triangular panels 1, 2, 3, 4, 5 and 6 which are formed by folds 47, 48 and 49 in the material of the covering element. Extension 42 is comprised of four triangular panels 10, 11, 12 and 13 and is formed by folds 47*a* and 48*a* in the material of the covering element. Likewise extensions 44 and 46 are formed by folds in the covering element and are on the same piece of material as central area 40.

Figure 2:
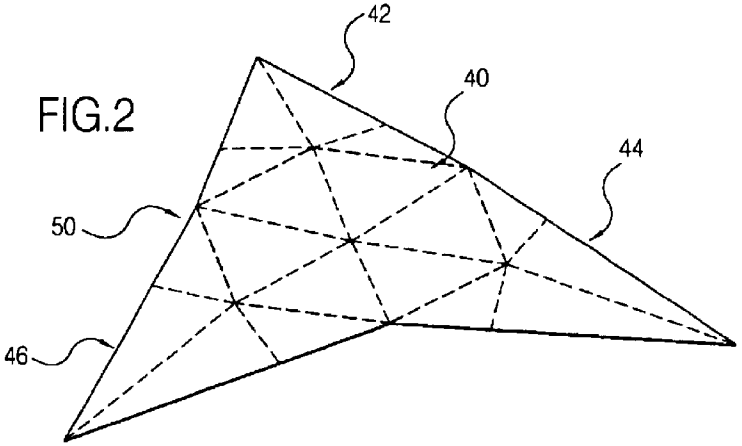
Figure 3:
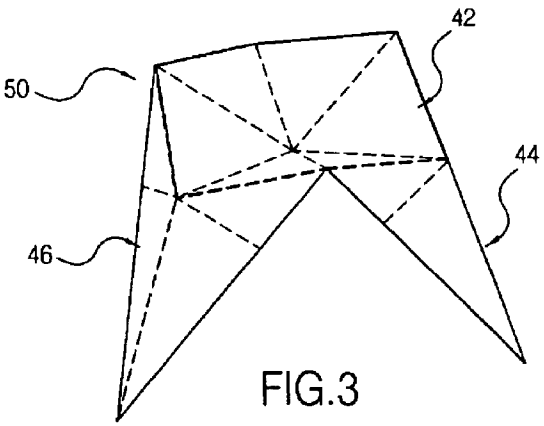
Figure 4:
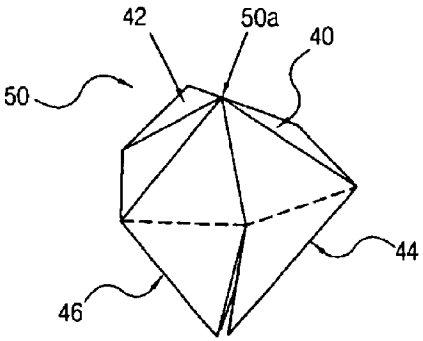

FIG. 2 shows covering element 50 in perspective view. FIG. 3 shows element 50 in a partially folded condition. Extensions 42, 44 and 46 fold inwards towards central element 40 FIG. 4 shows element 50 in a fully folded condition. It can be seen that, in the fully folded condition, the panel surfaces of the central element 40 will be hidden from view and folded inside the panels of the extensions. Also, the panels of the extensions will meet at a center point 50*a*, forming an essentially continuous surface. By having different printed information/pictures on different panels, different combinations of designs can be achieved. For example, a first design can be visible when the truss structure is fully expanded, and a second design will be visible (and the first design hidden from view and folded within) when the truss structure is fully contracted.

Figures 5, 6, 7:
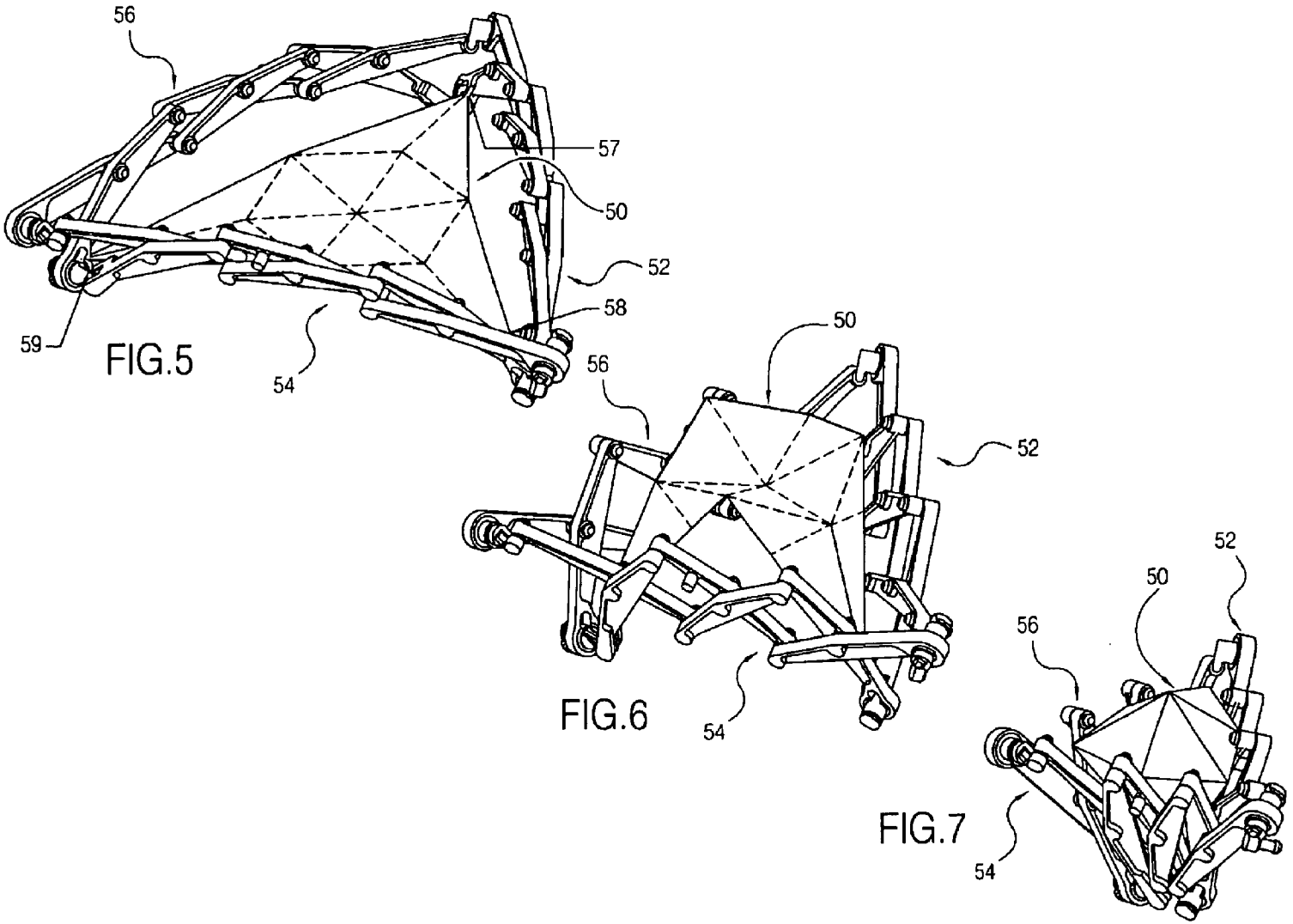
FIGS. 5–7 show a covering element attached to three tong linkages.

FIG. 5 shows covering element 50 attached to three tong linkages 52, 54 and 56 by three points 57, 58 and 59. These tong linkages, connected to one another to form a closed loop, can freely expand and contract. FIG. 6 shows the linkages in a partially contracted position, thereby compressing and folding up covering element 50. FIG. 7 shows the tong linkages in their fully contracted position, which in turn fully compresses element 50.

Figure 8:
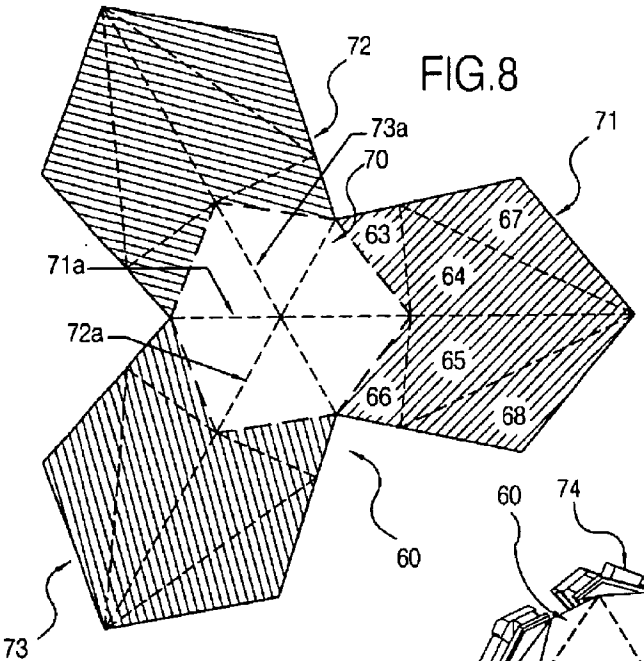
FIG. 8 shows an alternate embodiment of the covering element comprised of a central six-sided polygonal element and three extensions.

FIG. 8 shows an alternate embodiment of the invention which is a covering element 60 comprised of a central six-sided polygonal element 70, and three extensions 71, 72 and 73. Extension 71 is comprised of six triangular panels 63, 64, 65, 66, 67 and 68 formed by folds 71*a*, 72*a* and 73*a* in the material of the covering element.

Figure 9:
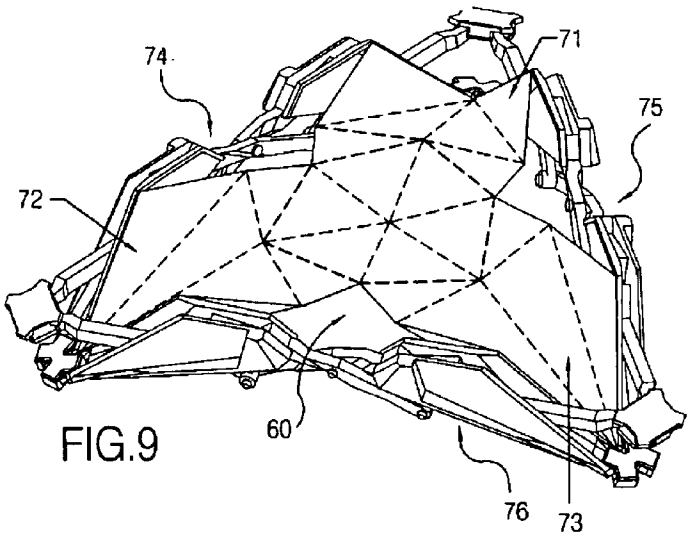
FIGS. 9–11 show the covering element of FIG. 8 connected to three tong linkages, forming a closed-loop element with covering element.
Figure 10:
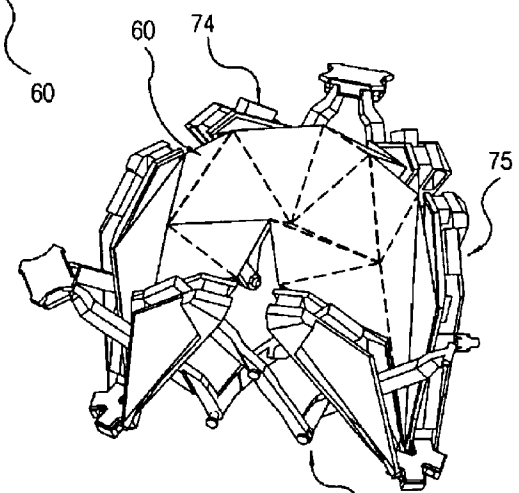
Figure 11:
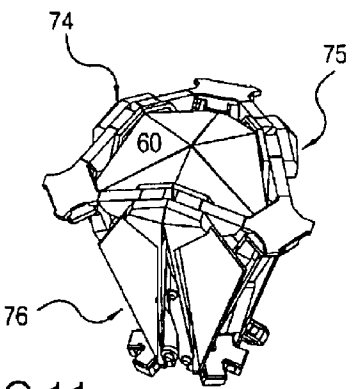

FIG. 9 shows covering element 60 attached to three tong linkages 74, 75 and 76 (again forming a closed loop). The attachments of the covering element are made by hinge connections along the perimeter of the three extensions 71, 72 and 73. FIGS. 10 and 11 show the tong linkages in their partially contracted and fully contracted positions respectively thereby compressing and folding up element 70.

Figure 13:
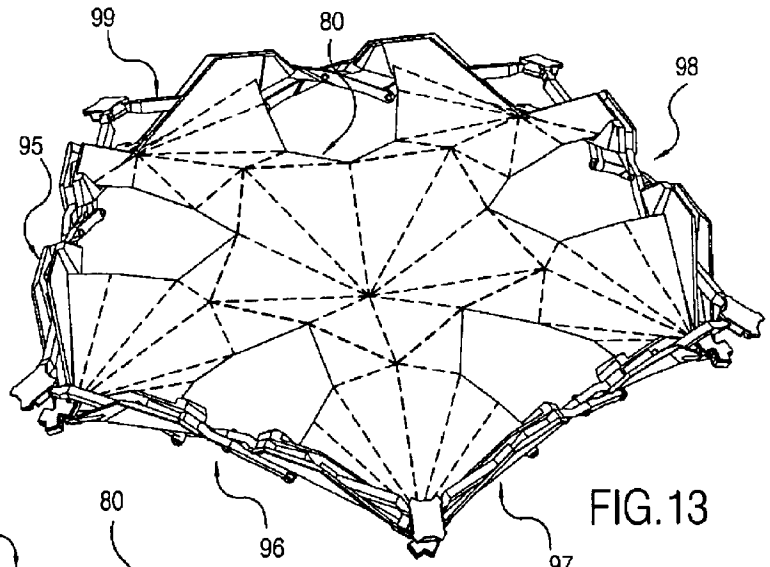
FIGS. 13–15 show the covering element of FIG. 12 attached to five tong linkages.
Figure 12:
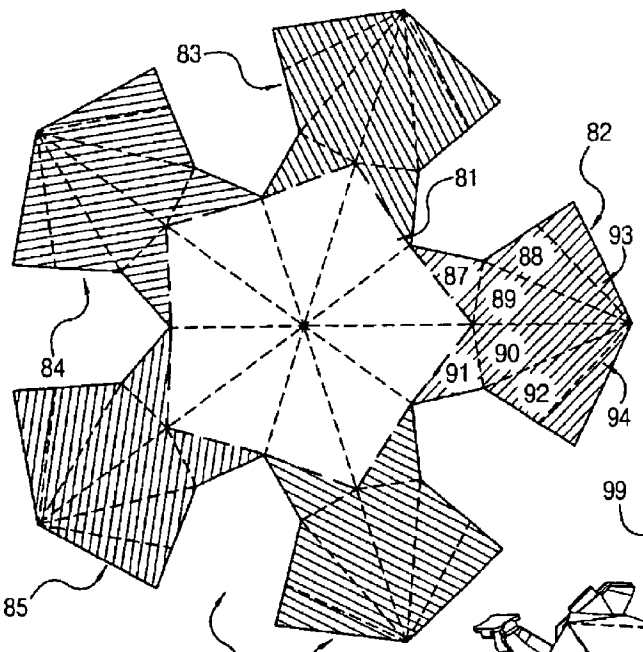
FIG. 12 shows a covering element which is comprised of a ten-sided polygonal element and five extensions.
Figure 14:
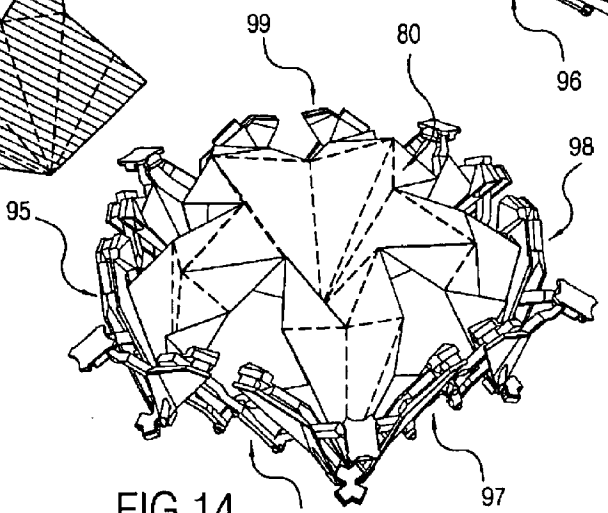
Figure 15:
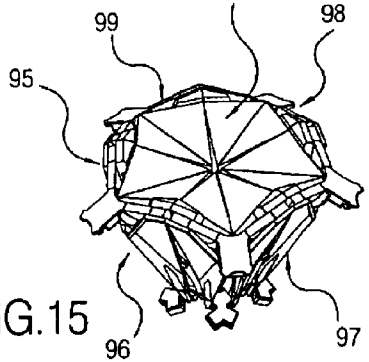

FIG. 12 shows a covering element 80 which is comprised of a ten-sided polygonal element 81 and five extensions 82, 83, 84, 85 and 86. Extension 82 is comprised of eight triangular panels 87, 88, 89, 90, 91, 92, 93 and 94. Again, the panels are formed by folds in the material of the covering element. FIG. 13 shows element 80 attached to five tong linkages 95, 96, 97, 98 and 99 These tong linkages are shown in their extended position. FIGS. 14 and 15 show the tong linkages in their partially contracted and fully contracted positions respectively, in turn compressing and folding up element 80.

Figure 16:
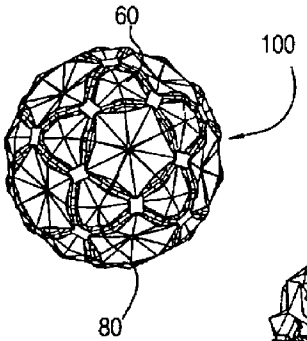
FIGS. 16–18 show an expanding sphere consisting of sixty tong linkages, twelve pentagonal covering elements and twenty triangular covering elements.
Figure 17:
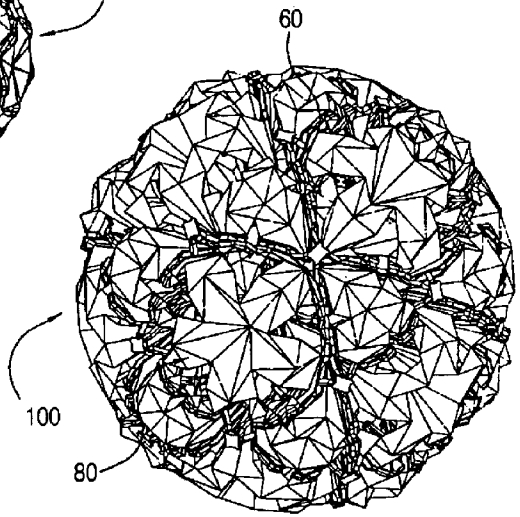
Figure 18:
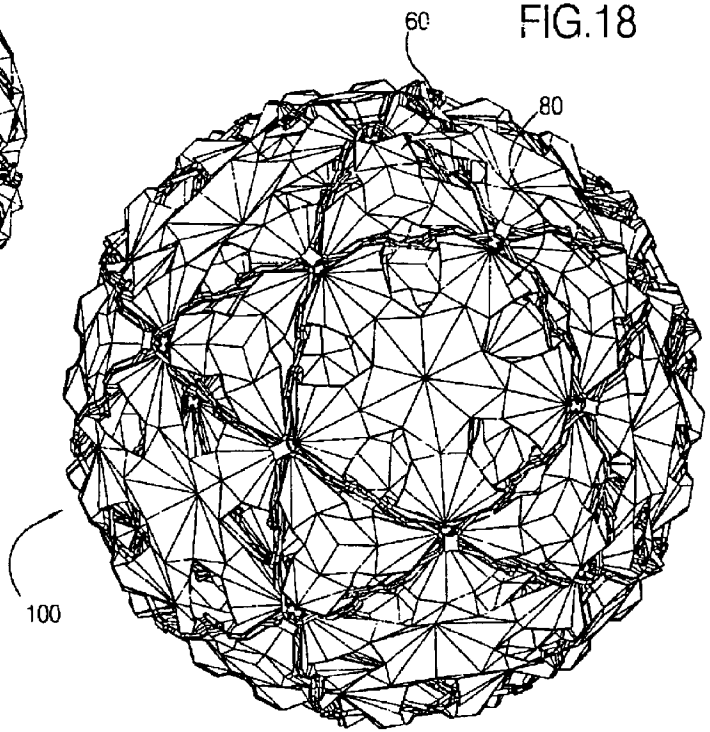

Complex structures can be created from linking together the elements (i.e., tong linkages with covering elements attached) discussed above. FIG. 16 shows an expanding sphere 100 consisting of sixty tong linkages, twelve pentagonal covering elements and twenty triangular covering elements. Expanding sphere 100 is shown in its fully compressed position. FIG. 17 shows the expanding sphere 100 in its partially folded position. FIG. 18 shows 100 in its fully extended position, the covering elements providing a "skin" for the sphere that essential covers the entire outer surface.

Figure 19:
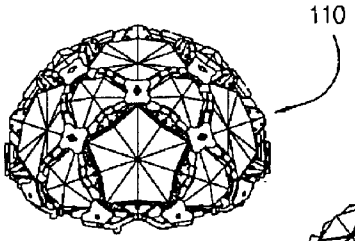
FIGS. 19–21 show an expanding dome consisting of thirty-five tong linkages, six pentagonal elements and ten triangular elements.
Figure 20:
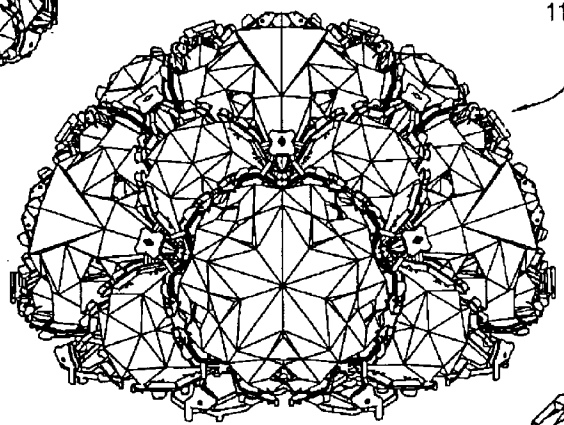
Figure 21:
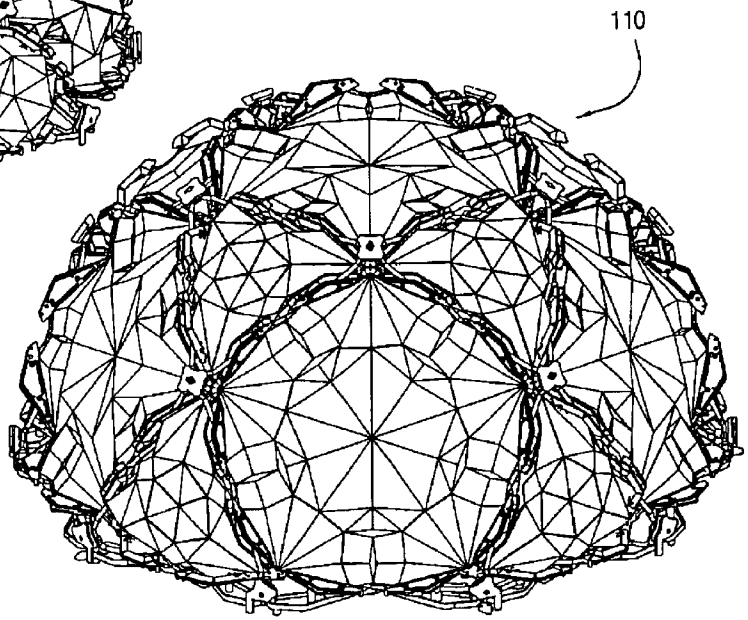

FIGS. 19, 20 and 21 show an alternate embodiment of the invention, which is an expanding dome 110 consisting of thirty-five tong linkages, six pentagonal elements and ten triangular elements. FIG. 19 shows the expanding dome 110 in its fully folded position. FIGS. 20 and 21 show 110 in its partially folded and fully extended positions respectively.

Figure 23:
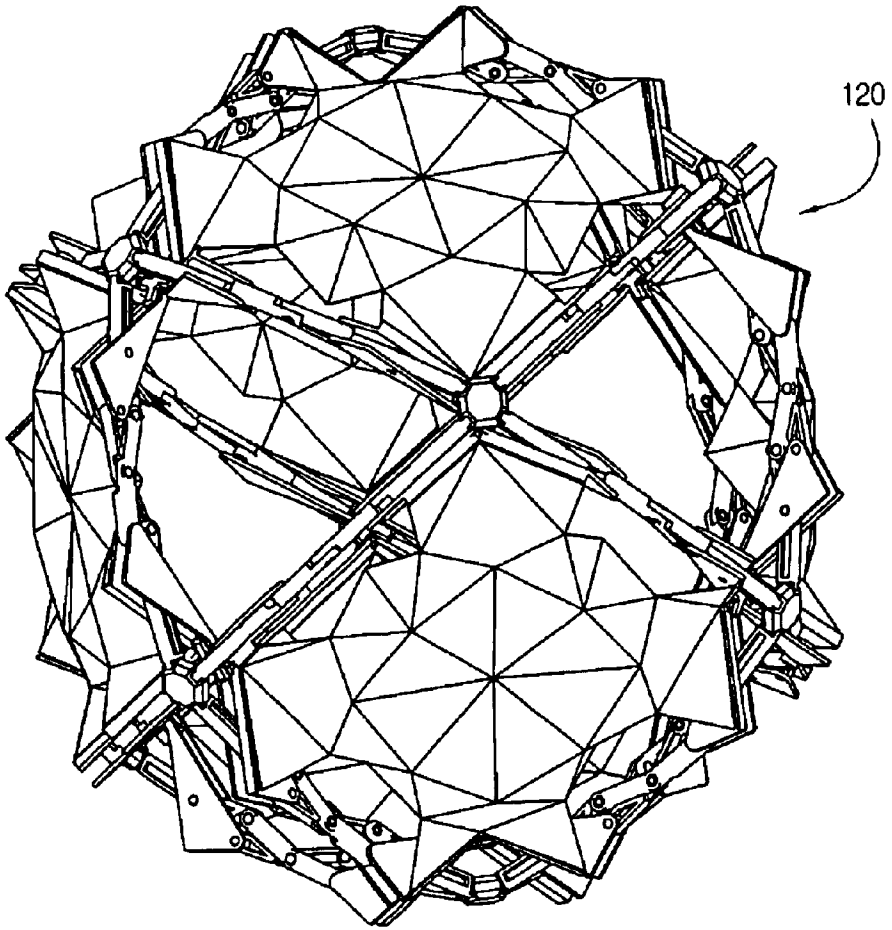
FIGS. 22–23 show an expanding sphere consisting of twenty-four tong linkages and six square covering elements.
Figure 22:
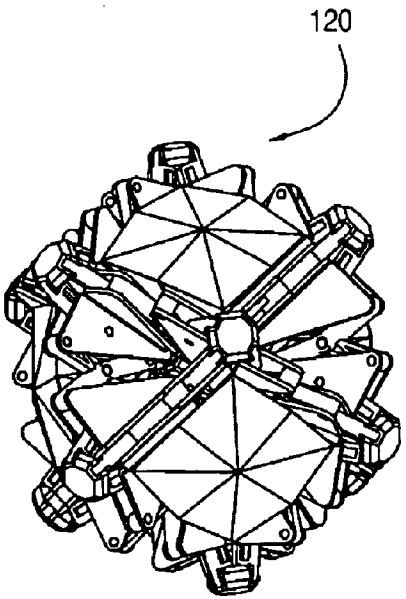

FIG. 22 shows another alternate embodiment of the invention which is a expanding sphere 120 consisting of twenty-four tong linkages and six square covering elements. Sphere 120 is shown in its fully compressed position. FIG. 23 shows sphere 120 in its extended position In alternative embodiments of the invention, panels on the covering elements can be constructed of separate pieces of material that are attached to one another by hinges to form the covering element.

It will be appreciated that the instant specification, drawings and claims set forth by way of illustration and not limitation, and that various modification and changes may be made without departing from the spirit and scope of the present invention.

What is claimed is:

1. A reversibly expandable dome with covering elements comprising:

a plurality of covered closed loop reversibly expandable truss structure elements, each said truss element comprising a closed-loop truss structure having at least three tong assemblies connected to one another to form a closed loop and a covering element being connected to said closed-loop truss structure;

wherein said covering element comprises a single piece of material defined by a central polygonal area having a perimeter and including at least six triangular panels which share a common central vertex, each triangular panel having a side along said perimeter, said triangular panels formed by folds in said material, said material further defined by at least three extensions each including at least two hinged polygonal panels which lead to an extension outer-most corner, said extensions formed by folds in the material, each of said at least two polygonal panels of each said extension having a side hingedly connected to the perimeter side of one of said triangular panels.

2. The dome of claim 1, wherein said covering element is attached to said reversibly expandable truss structure by attaching said extension outermost corners to a hub element of said truss structure.

3. The dome of claim 1, wherein each said hinged polygonal panel is triangular shaped.

4. The dome of claim 1, wherein said central polygonal area is hexagonal shaped.

5. The dome of claim 1, wherein each hinged polygonal panel of each said extension comprises at least two foldable panels.

6. The dome of claim 5, wherein said at least two foldable panels are each of triangular configuration.

7. The dome of claim 1, wherein said covering element is constructed of a cardboard material.

8. The dome of claim 1, wherein the covering element is constructed of a plastic material.

9. The dome of claim 1, wherein at least some of said six triangular panels and said hinged polygonal panel have a printed design depicted thereon.

10. The dome of claim 9, wherein said printed design forms a first design when said truss structure is fully contracted and a second different design when said truss structure is fully expanded.

11. A reversibly expandable globe with covering elements comprising:

a plurality of covered closed loop reversibly expandable truss structure elements, each said truss element comprising a closed-loop truss structure comprised of at least three tong assemblies connected to one another to form a closed loop and a covering element being connected to said closed-loop truss structure;

wherein said covering element comprises a single piece of material defined by a central polygonal area having a perimeter and including at least six triangular panels which share a common central vertex, each triangular panel having a side along said perimeter, said triangular panels formed by folds in said material, said material further defined by at least three extensions each including at least two hinged polygonal panels which lead to an extension outer-most corner, said extensions formed by folds in the material, each of said at least two polygonal panels of each said extension having a side hingedly connected to the perimeter side of one of said triangular panels.

12. The globe of claim 11, wherein said covering element is attached to said reversibly expandable truss structure by attaching said extension outermost corners to a hub element of said truss structure.

13. The globe of claim 11, wherein each said hinged polygonal panel is triangularly shaped.

14. The globe of claim 11, wherein said central polygonal area is hexagonal shaped.

15. The globe of claim 11, wherein each hinged polygonal panel of each said extension comprises at least two foldable panels.

16. The globe of claim 15, wherein said at least two foldable panels are each of triangular configuration.

17. The globe of claim 11, wherein said covering element is constructed of a cardboard material.

18. The globe of claim 11, wherein the covering element is constructed of a plastic material.

19. The globe of claim 11, wherein at least some of said six triangular panels and said hinged polygonal panel have a printed design depicted thereon.

20. The globe of claim 19, wherein said printed design forms a first design when said truss structure is fully contracted and a second different design when said truss structure is fully expanded.

* * * * *